US005101734A

United States Patent [19]

Sakai

[11] Patent Number: 5,101,734

[45] Date of Patent: Apr. 7, 1992

[54] FLEXIBLE RAIL

[75] Inventor: Hideyuki Sakai, Okazaki, Japan

[73] Assignees: Nichidai Industrial Co Ltd, Aichi; Daiwa Paint Trading Co Ltd, Nagoya, both of Japan

[21] Appl. No.: 702,098

[22] Filed: May 20, 1991

[30] Foreign Application Priority Data

May 21, 1990 [JP] Japan ..... 2-131589

[51] Int. Cl.[5] ..... B61B 3/00

[52] U.S. Cl. ..... 104/89; 104/95; 104/106; 238/1; 238/122; 198/861.2; 198/838

[58] Field of Search ..... 104/89, 93, 94, 95, 104/106, 111; 238/10 C, 10 E, 10 F, 10 R, 15, 122, 1; 198/861.2, 838

[56] References Cited

U.S. PATENT DOCUMENTS

| | | | |
|---|---|---|---|
| 2,208,269 | 7/1940 | Cartlidge | 198/861.2 X |
| 2,795,315 | 6/1957 | Hahir et al. | 198/861.2 X |
| 4,154,336 | 5/1979 | Sorokin | 198/861.2 |
| 4,254,907 | 3/1981 | Pine | 238/10 R X |
| 4,449,665 | 5/1984 | Goldfarb et al. | 238/10 R |
| 4,540,119 | 9/1985 | Neuhierl | 238/10 R |
| 5,043,052 | 8/1991 | Sakai | 104/111 X |

*Primary Examiner*—Robert J. Oberleitner
*Assistant Examiner*—Kevin D. Rutherford

[57] ABSTRACT

A flexible rail comprises rail pieces arranged in line, laterally opposed side plates, and laterally opposed connecting plates. Each rail piece includes a generally I-shaped member and a shelter member which is fixed to a top of the I-shaped member. The opposed side plates are fixed to respective side walls of the shelter member. The side plate overlaps one side of the rail piece. The connecting plate is fixed to a rear one of adjacent side plates, and is connected to the front side plate for pivotal movement. Thus, the rail piece, the side plates fixed thereto, and the connecting plates fixed to the side plates, as one body, are capable of pivotal movement. The rail piece, the side plate, and the connecting plate each may include an upper tapered portion with opposed upper inclined end faces starting from longitudinally opposed ridges, respectively, and a lower tapered portion with opposed lower inclined end faces starting from the longitudinally opposed ridges, respectively, except that a foremost rail piece and a rearmost rail piece each have an inner upper inclined end face starting from an inner ridge and an inner lower inclined end face starting from the inner ridge and an outer straight end face, and a foremost side plate and a rearmost side plate each have an inner upper inclined end face starting from an inner ridge and an inner lower inclined end face starting from the inner ridge and an outer straight end face. All the ridges are located at the same level.

31 Claims, 10 Drawing Sheets

FLEXIBLE RAIL

FIELD OF THE INVENTION

This invention relates to flexible rails.

BACKGROUND OF THE INVENTION

The inventor proposed in Japanese Patent Application No. 60-192863 (published under No. 62-54097 on Mar. 9, 1987) an electrodeposition coating system which includes a trolley conveyor and tanks supported on vertically extensible lifts. The trolley conveyor comprises first to fifth rails connected to one another. The first rail is straight. The second rail is curved from a lower left to an upper right. The third, or central rail is straight. The fourth rail is curved from an upper left to a lower right. The fifth rail is straight. The central rail is located in a higher position than the other rails. Each rail is a single continuous rigid rail with an inner space extending along the rail, with a generally inverted U-shaped vertical cross section, with opposed open ends, with a pair of laterally opposed bottom portions, and with a bottom space located between the opposed bottom portions. The rails provide a single continuous inner path. A roller chain is passed through the continuous inner path, and is supported on the bottom portions of the rails at its rollers. Hangers are suspended from the roller chain through the opposed bottom spaces. Works to be electrodeposition coated are hung from the hangers. All the rails are fixed rails. Thus, the trolley conveyor is a fixed one. The roller chain is moved intermittently. The tanks are located directly below the central rail. When the roller chain is stopped, the lifts are extended to move the tanks upward. Thus, the tanks accommodate the works hung from the hangers, so that the works are immersed in liquids filled into the tanks for a required period of time. Then, the lifts are retracted. Then, the roller chain is restarted. When each work has come to a position directly above the next tank, the roller chain is stopped again. Then, the lifts are extended again so that each work is accommodated in the next tank. Thus, with such a prior art, the tanks are raised after each intermittent movement of the roller chain.

However, the act of raising heavy objects, i.e., the tanks containing necessary liquids for the electrodeposition coating of works, is not of advantage to an efficient coating operation. If it is possible to move the central rail vertically, the coating operation may be made more efficiently since it is not necessary to move the tanks vertically. Since the works hung from the hangers are relatively small and lightweight objects, the central rail may be moved vertically with a smaller energy than the tanks. Thus, a technique for moving the central rail vertically has been desired. The inventor herein provides a "flexible rail" that actualizes such a technique.

SUMMARY OF THE INVENTION

Accordingly, it is an object of the invention to provide a rail which is flexible in a vertical plane.

Another object of the invention is to provide a rail of the foregoing character which can be used to provide a flexible trolley conveyor.

Another object of the invention is to provide a flexible conveyor with a rail of the foregoing character.

Still another object of the invention is provide an electrodeposition coating system with a flexible trolley conveyor.

According to the invention, a flexible rail is provided which comprises rail pieces arranged in line, laterally opposed side plates, and laterally opposed connecting plates. Each rail piece includes a generally I-shaped member and a shelter member which is fixed to a top of the I-shaped member. The opposed side plates are fixed to respective side walls of the shelter member. The side plate overlaps one side of the rail piece. The connecting plate is fixed to a rear one of adjacent side plates, and is connected to the front side plate for pivotal movement. The rail piece, the side plate, and the connecting plate each may include an upper tapered portion with opposed upper inclined end faces starting from longitudinally opposed ridges, respectively, and a lower tapered portion with opposed lower inclined end faces starting from the longitudinally opposed ridges, respectively, except that a foremost rail piece and a rearmost rail piece each have an inner upper inclined end face starting from an inner ridge and an inner lower inclined end face starting from the inner ridge and an outer straight end face, and a foremost side plate and a rearmost side plate each have an inner upper inclined end face starting from an inner ridge and an inner lower inclined end face starting from the inner ridge and an outer straight end face. All the ridges are located at the same level. The ridges may be clear-cut angles. The angle of inclination of each inclined end face may be 4 degrees with respect to the ridge. Each intermediate rail piece, each intermediate side plate, and each connecting plate may have substantially the same longitudinal dimension. The intermediate side plate may be offset against the rail piece to which the intermediate rail piece is fixed, in one longitudinal direction by a first predetermined distance, while each connecting plate may be offset against the intermediate side plate to which the connecting plate is fixed, in an opposed longitudinal direction by a second predetermined distance which is substantially twice the first predetermined distance.

BRIEF DESCRIPTION OF THE DRAWING

FIG. 1 shows intermediate rail pieces, intermediate side plates fixed thereto, and a connecting plate;

DETAILED DESCRIPTION OF PREFERRED EMBODIMENTS

Figure 1:
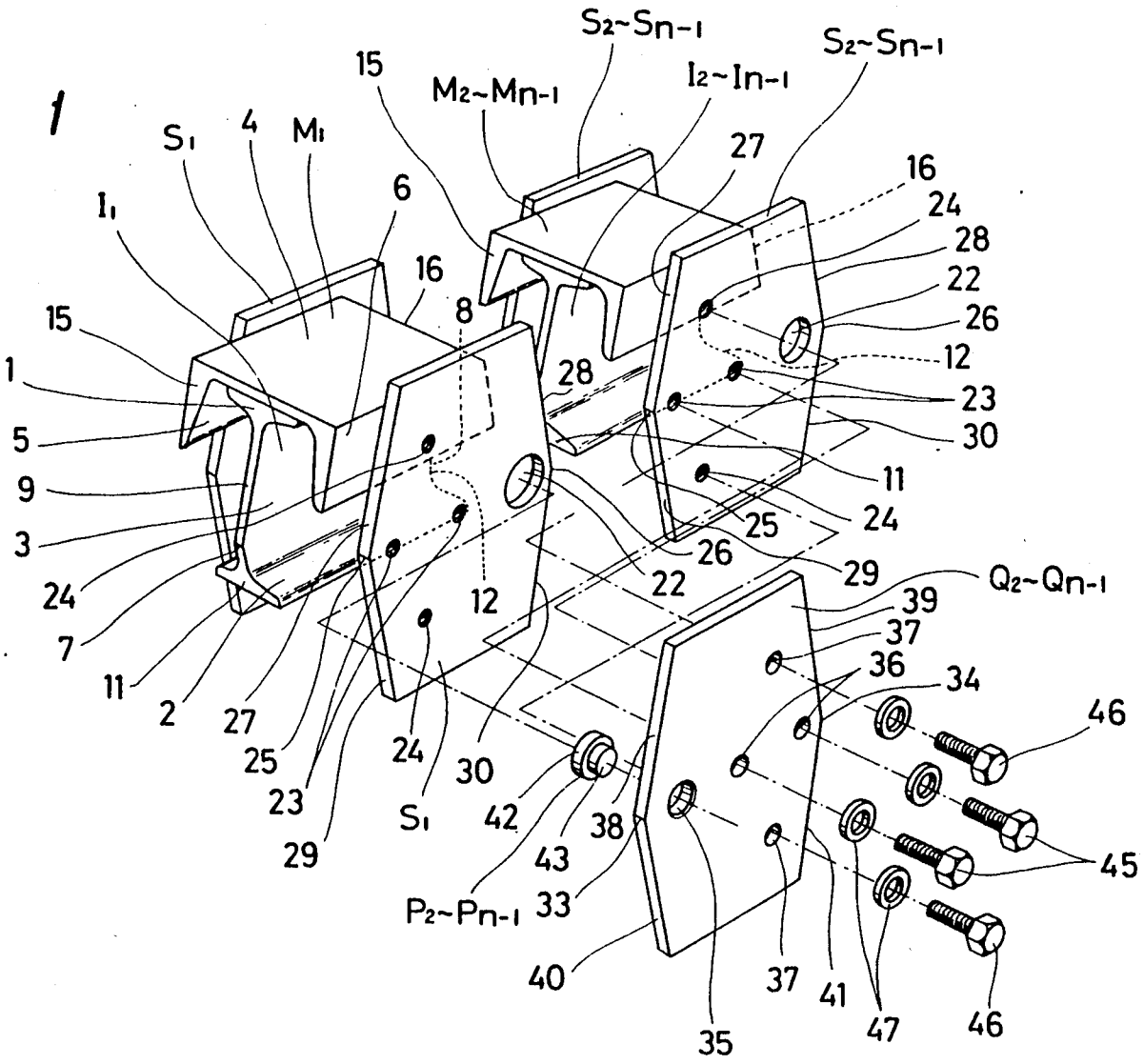
FIG. 1 shows major components of a flexible rail of the invention. That is.

Referring now to the drawings, a flexible rail F which embodies the invention in one preferred form will now be described in detail.

The flexible rail F according to the invention comprises rail pieces, side plates $S_O$ to $S_n$ fixed to the rail pieces, and connecting plates $Q_1$ to $Q_n$ connecting the side plates together.

Each rail piece includes an I-shaped member ($I_O$ to $I_n$) and a shelter member ($M_O$ to $M_n$) fixed to the I-shaped member.

Figure 7:
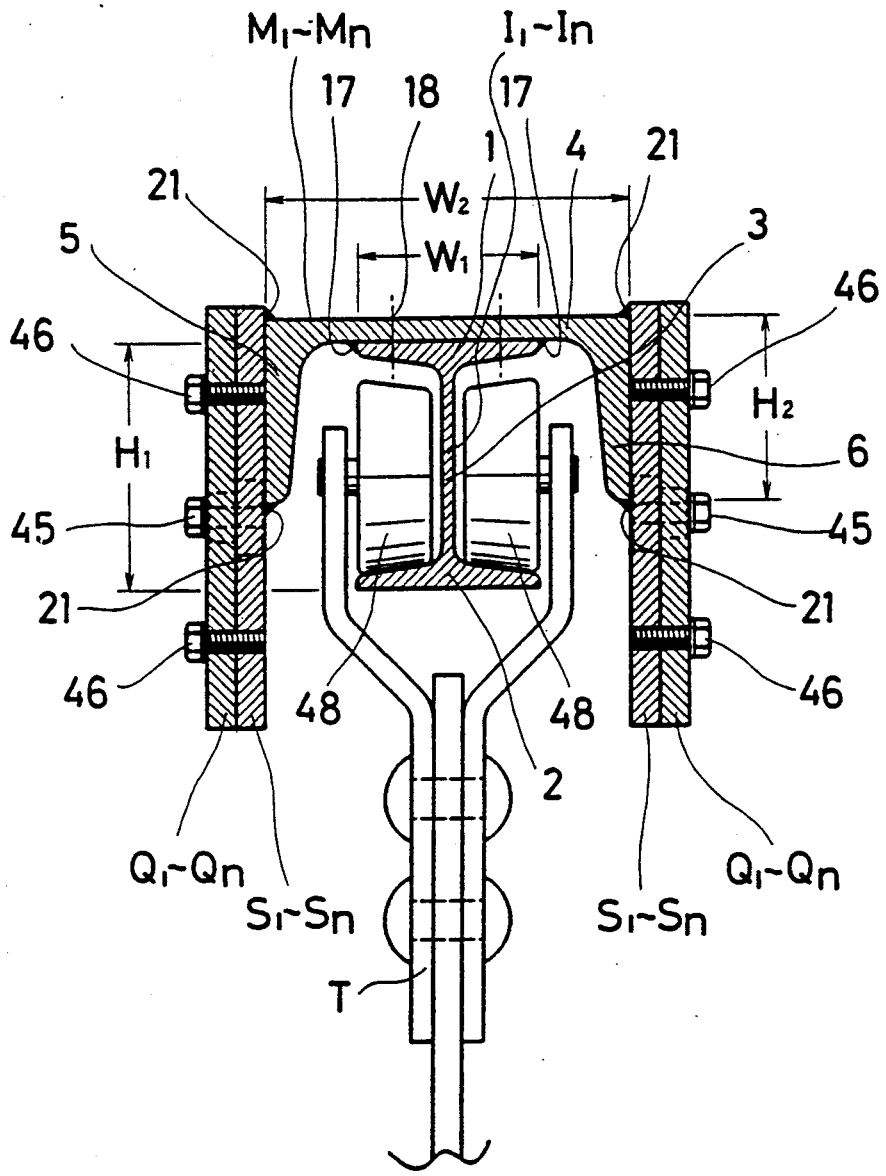
FIG. 7 is a cross section taken on line I—I of FIG. 6.
Figure 8:
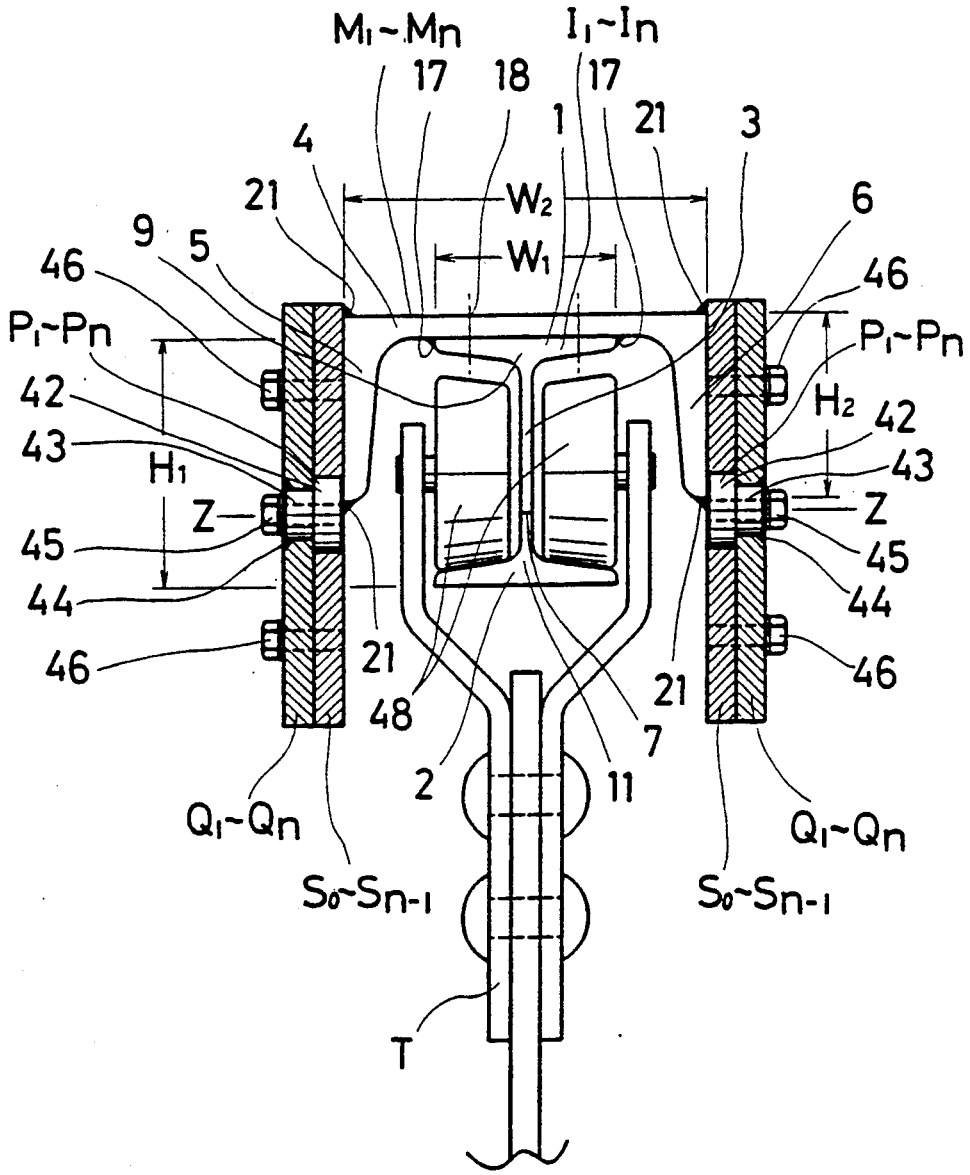
FIG. 8 is a cross section taken on line II—II of FIG. 6.

Referring to FIGS. 7 and 8 in particular, the I-shaped member generally has the shape of the letter "I" in its vertical cross section, and comprises a top 1, a middle portion 3 and a bottom 2. The shelter member is fixed to the top 1 of the I-shaped member, and comprises a horizontal portion 4 and opposed side walls 5 and 6. The width $W_2$ of the horizontal portion 4 is substantially twice the width $W_1$ of the I-shaped member. Each side wall (5 or 6) has a height $H_2$ which is substantially equal to one half of the width $W_2$ of the horizontal portion 4. The height $H_2$ is substantially two thirds of the height $H_1$ of the I-shaped member.

I-shaped Member

The rail pieces except the foremost one (the leftmost one in FIGS. 6 and 9) and the rearmost one (the rightmost one in FIGS. 6 and 8) will be hereinafter referred to as "intermediate rail pieces".

Figure 2:
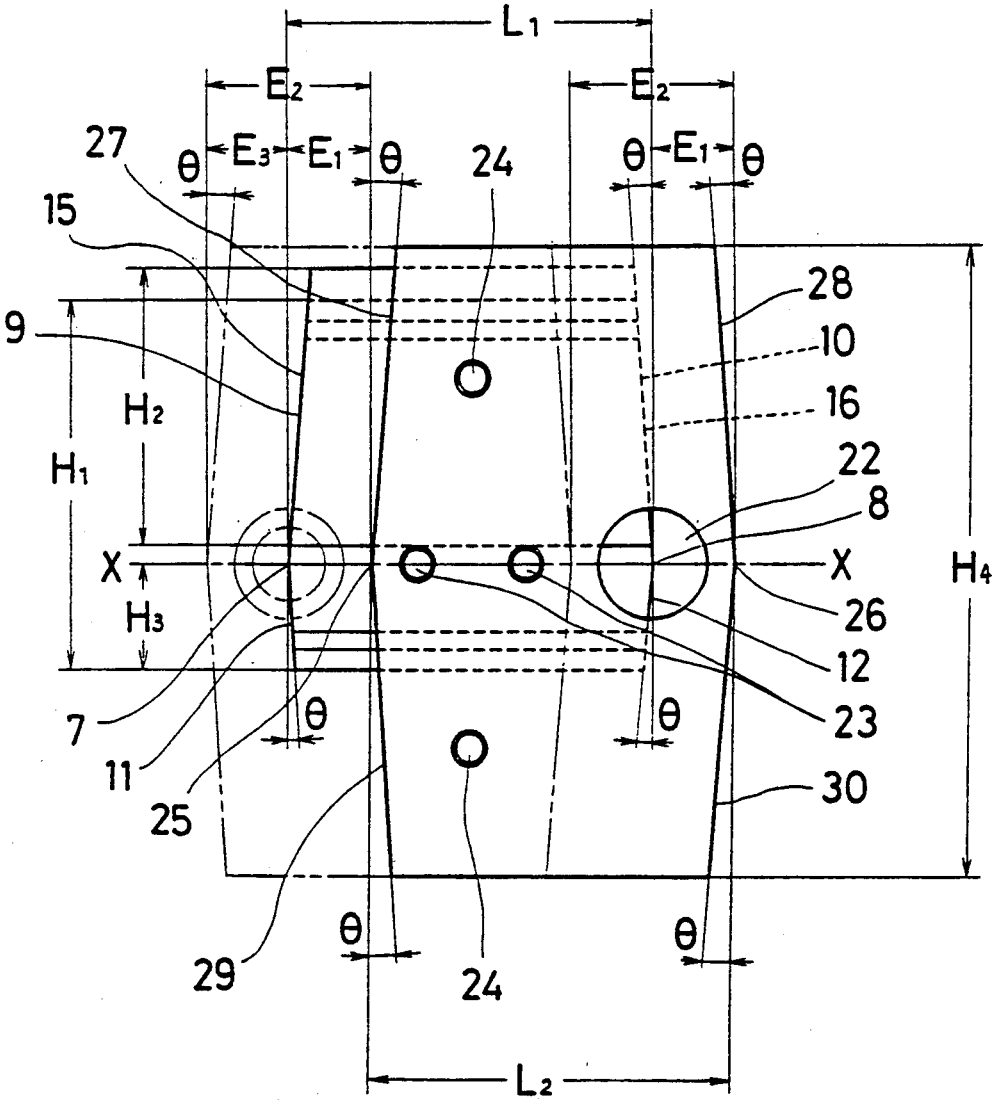
FIG. 2 shows an intermediate rail piece, an intermediate side plate fixed thereto, and a connecting plate fixed to the intermediate side plate.
Figure 3:
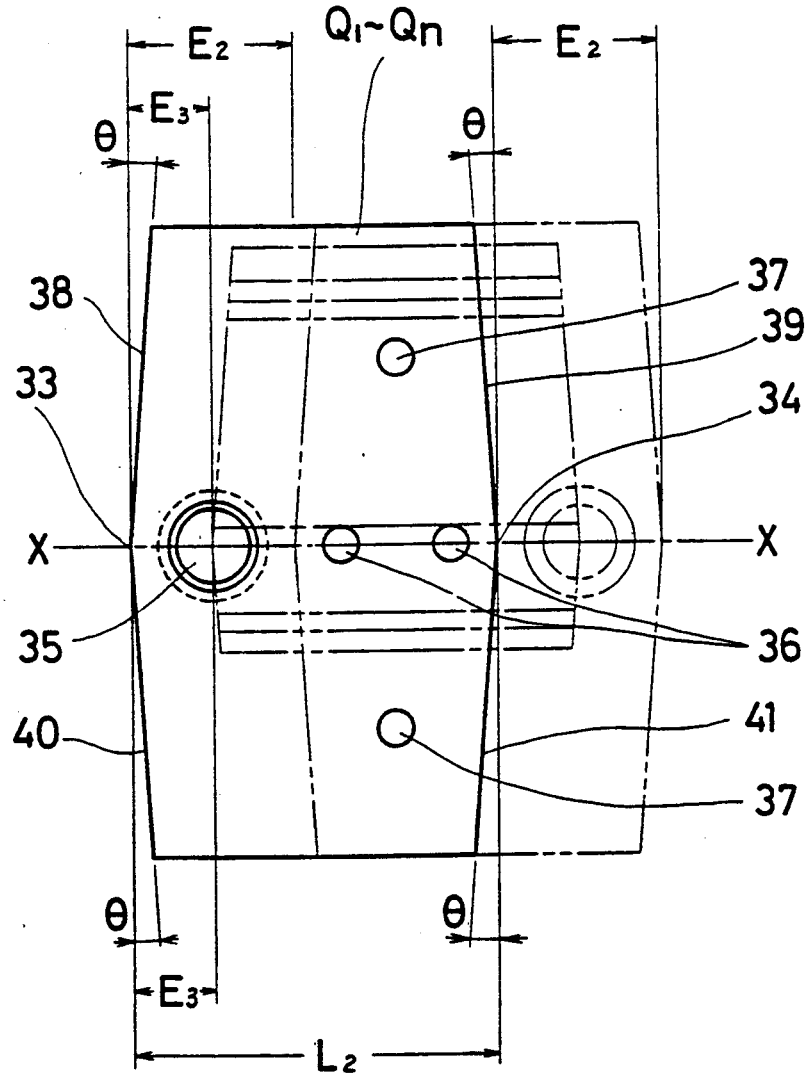
FIG. 3 shows a connecting plate.
Figure 6:
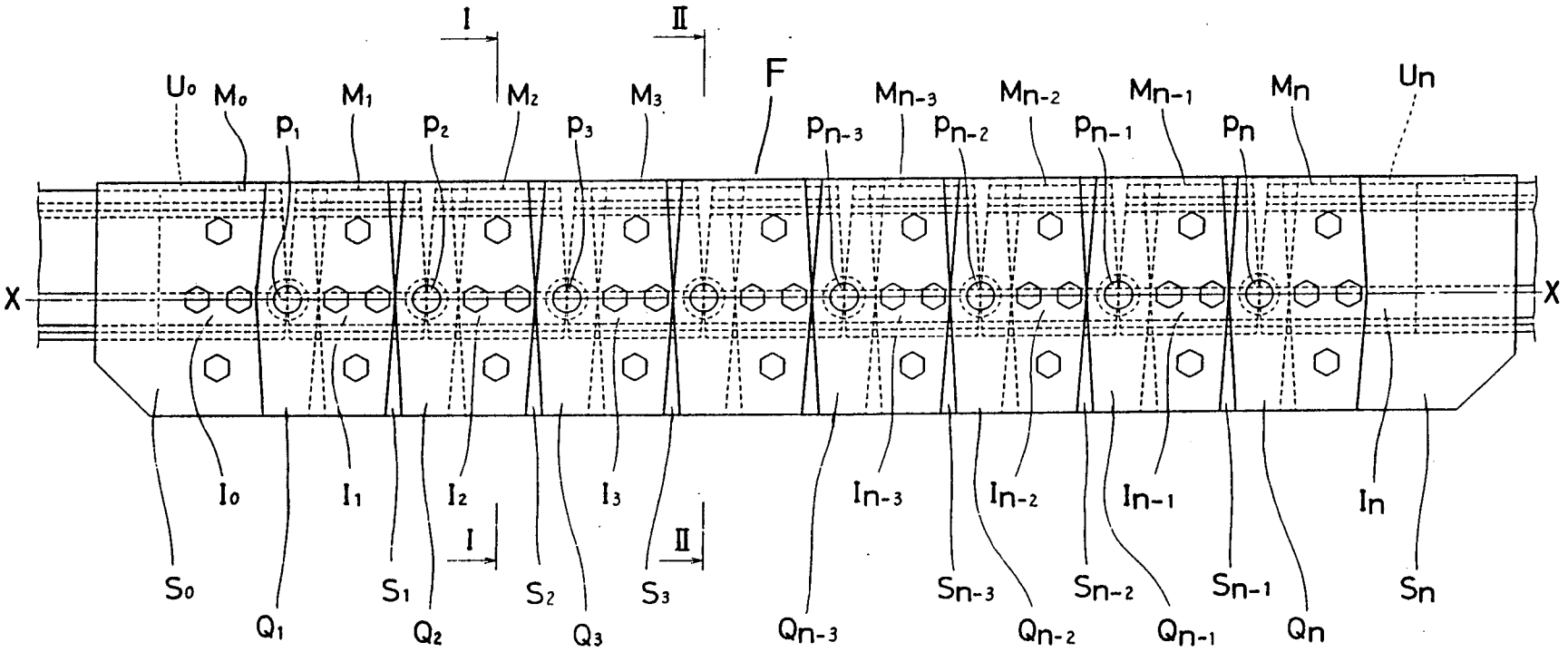
FIG. 6 shows a flexible rail of the invention.

The I-shaped member ($I_1$ to $I_{n-1}$) of each intermediate rail piece includes longitudinally opposed ridges 7 and 8 (FIGS. 1 and 2). The ridges 7 and 8 are located at a level X—X (FIGS. 2 and 6). The level X-X is at a height of $H_3$ from the lower surface of the I-shaped member. The height $H_3$ is substantially one third of the height $H_1$ of the I-shaped member. The illustrated ridges 7 and 8 are clear-cut angles rather than otherwise. However, if desired, rounded ridges may be provided instead of such ridges. The I-shaped member also includes an upper portion which is upwardly tapered from the ridged portion (or widest portion) and a lower portion which is downwardly tapered from the ridged portion. Reference numeral 9 designates a T-shaped front end face of the upper portion (of the I-shaped member) which is rearwardly inclined from the front ridge 7 at an angle of some 4 degrees. This angle is designated by the letter $\theta$. Reference numeral 10 designates a T-shaped rear end face of the upper portion which is forwardly inclined from the rear ridge 8 at the same angle. Reference numeral 11 designates an inverted T-shaped front end face of the lower portion (of the I-shaped member) which is rearwardly inclined from the front ridge 7 at an angle of some 4 degrees. This angle is also designated by the letter $\theta$. Reference numeral 12 designates an inverted T-shaped rear end face of the lower portion which is forwardly inclined from the rear ridge 8 at the same angle.

Figure 4:
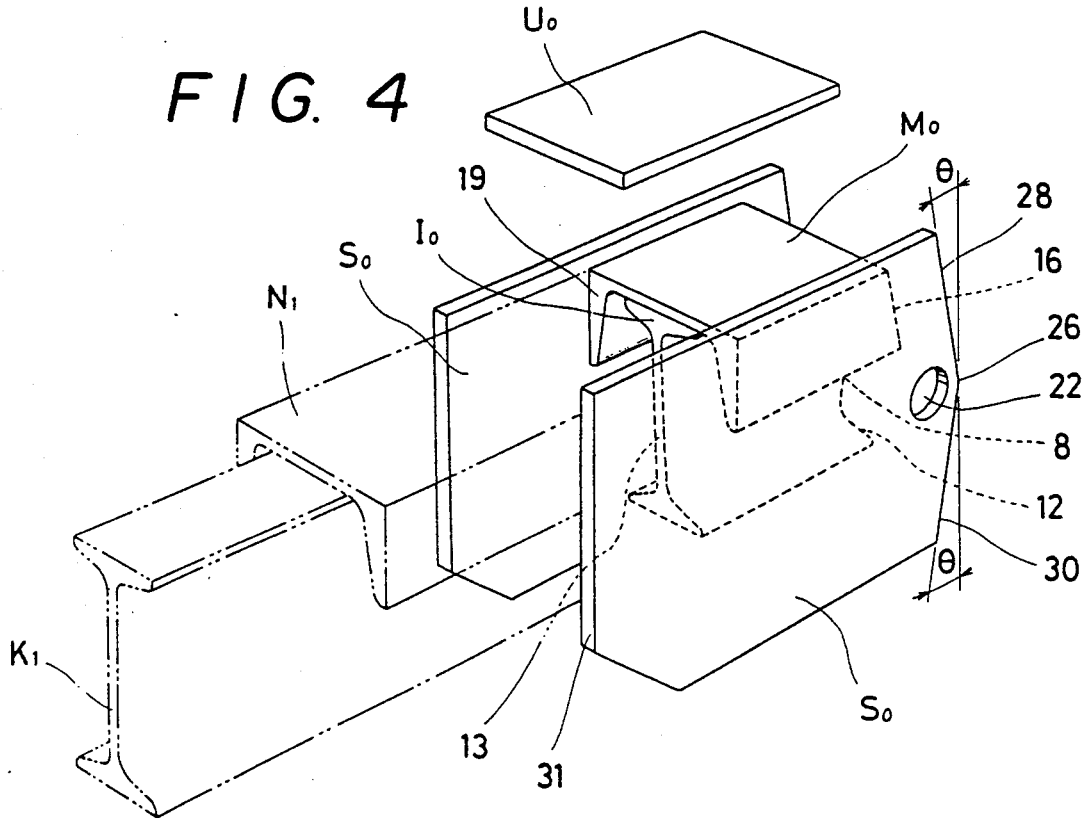
FIG. 4 shows a foremost rail piece and side plates fixed thereto.
Figure 5:
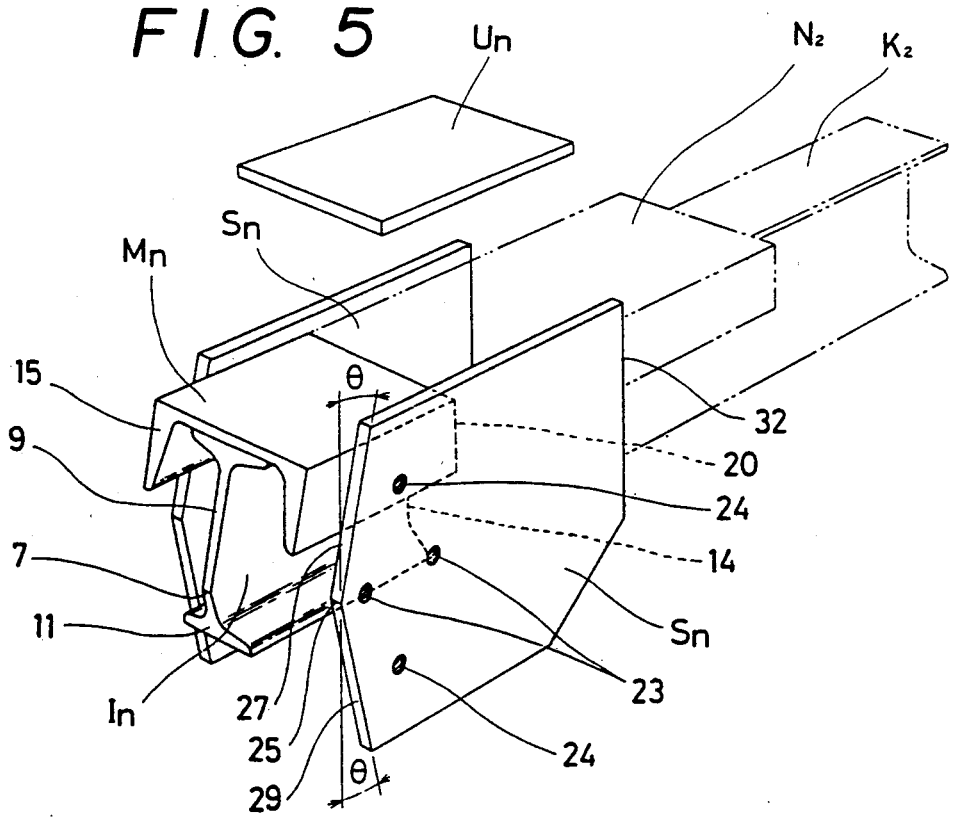
FIG. 5 shows a rearmost rail piece and side plates fixed thereto.

The I-shaped member $I_O$ of the foremost rail piece has a flat or straight front end face 13, a T-shaped upper rear end face 10 which is forwardly inclined from a rear ridge 8 at an angle of some 4 degrees, and an inverted T-shaped lower rear end face 12 which is forwardly inclined from the rear ridge 8 at the same angle (FIG. 4). The I-shaped member $I_n$ of the rearmost rail piece has a flat or straight rear end face 14, a T-shaped upper front end face 9 which is rearwardly inclined from a front ridge 7 at an angle of some 4 degrees, and an inverted T-shaped lower front end face 11 which is rearwardly inclined from the front ridge 7 at the same angle (FIG. 5). All these angles are designated by the letter $\theta$.

The I-shaped members ($I_O$ to $I_n$) are in contact with each other at the ridges 7 and 8 thereof.

Shelter Member

As described before, the shelter member is fixed to the top 1 of the I-shaped member. For example, the shelter member may be fixed thereto by welding, as indicated by reference numeral 17 (FIGS. 7 and 8). Alternatively, if desired, the shelter member may be bolted thereto.

The shelter member has the same length as or a slightly smaller length than the I-shaped member.

The shelter member ($M_1$ to $M_{n-1}$) of each intermediate rail piece has the shape of a trapezoid in its side elevation, and has an inclined front end face 15 and an inclined rear end face 16 (FIG. 2). The front end face 15 is inclined in the same direction as the upper front end face 9 of the I-shaped member at the same angle as the upper front end face 9. The rear end face 16 is inclined in the same direction as the upper rear end face 10 of the I-shaped member at the same angle as the upper rear end face 10. The side walls 5 and 6 of the shelter member substantially coincide with part of the I-shaped member as viewed from the sides of the side walls 5 and 6. The bottom of the shelter member is located at a higher level than the ridges 7 and 8 of the I-shaped member (FIG. 2).

The shelter member $M_O$ of the foremost rail piece has a vertical front end face 19 and a rear end face 16 which is inclined in the same direction as the upper rear end face 10 of the associated I-shaped member $I_O$ at the same angle as the upper rear end face 10 (FIG. 4). The side walls 5 and 6 of the shelter member $M_O$ substantially coincide with part of the associated I-shaped member 10 as viewed from the sides of the side walls 5 and 6.

The shelter member $M_n$ of the rearmost rail piece has a vertical rear end face 20 and a front end face 15 which is inclined in the same direction as the upper front end face 9 of the associated I-shaped member In at the same angle as the upper front end face 9 (FIG. 5). The side walls 5 and 6 of the shelter member $M_n$ substantially coincide with part of the associated I-shaped shaped member $I_n$ as viewed from the sides of the side walls 5 and 6.

Referring to FIGS. 4 and 6, a rail construction comprising a long shelter member $N_1$ and a long I-shaped member $K_1$ may be fixed to the foremost rail piece by an upper connecting plate $U_O$. One end face (vertical end face) of the long shelter member $N_1$ may be brought into contact with the vertical front end face 19 of the foremost shelter member $M_O$, and one end face (vertical end face) of the long I-shaped member $K_1$ may be brought into contact with the straight (vertical) front end face 13 of the foremost I-shaped member $I_O$.

Referring to FIGS. 5 and 6, a rail construction comprising a long shelter member $N_2$ and a long I-shaped member $K_2$ may be fixed to the rearmost rail piece by an upper connecting plate $U_n$. One end face (vertical end face) of the long shelter member $N_2$ may be brought into contact with the vertical rear end face 20 of the rearmost shelter member $M_n$, and one end face (vertical end face) of the long I-shaped member $K_2$ may be brought into contact with the straight (vertical) rear end face 14 of the rearmost I-shaped member $I_n$.

Side Plate

A pair of opposed side plates ($S_O$ to $S_n$) are fixed to the respective side walls 5 and 6 of the shelter member of each rail piece. For example, the side plates may be fixed thereto by welding as indicated by reference numeral 21 (FIGS. 7 and 8).

Reference numeral $S_O$ designates the side plates fixed to the foremost rail piece. Reference numeral $S_n$ designates the side plates fixed to the rearmost rail piece. Side plates $S_1$ to $S_{n-1}$ (intermediate side plates) are fixed to the intermediate rail pieces, respectively.

Each intermediate side plate ($S_1$ to $S_{n-1}$) has a width $L_2$ which is substantially equal to the length $L_1$ of the rail piece to which the intermediate side plate is fixed.

Referring to FIGS. 1 and 2, the intermediate side plate is rearwardly offset against the associated rail piece by a distance El which is about one fifth of the width $L_2$ of the intermediate side plate. The intermediate side plate comprises an upper portion which is upwardly tapered from a widest portion thereof and a lower portion which is downwardly tapered from the widest portion thereof. The widest portion of the intermediate side plate is located at the same level X—X as the widest portion of the associated rail piece. Reference numerals 25 and 26 designate longitudinally opposed ridges of the intermediate side plate, or opposed ends of the widest portion thereof. Reference numerals 27 and 28 designate opposed sides of the upper tapered portion of the intermediate side plate, while reference numerals 29 and 30 designate opposed sides of the lower tapered portion thereof. The upper opposed sides 27 and 28 are inclined at an angle of some 4 degrees. Also, the lower opposed sides 29 and 30 are inclined at an angle of some 4 degrees. These angles are designated by the letter $\theta$. The illustrated ridges 25 and 26 are clear-cut angles rather than otherwise. However, if desired, rounded ridges may be provided instead of such ridges.

Referring to FIG. 4, the foremost side plate S0 has a straight front end 31 and a ridged rear end which includes an upper inclined end face 28 and a lower inclined end face 30. The upper and lower inclined end faces 28 and 30 are inclined at an angle of some 4 degrees. This angle is designated by the letter $\theta$. Reference numeral 26 designates a rear ridge of the foremost side plate from which the upper and lower inclined end faces 28 and 30 start. The rear ridge 26 is located at the same level X-x as the ridge 8 of the associated rail piece and the ridges 25 and 26 of the intermediate side plate. The ridge 26 of the foremost side plate is rearwardly spaced apart from the ridge 8 of the associated rail piece (foremost rail piece) by the same distance $E_1$ as the intermediate side plate is offset against the associated rail piece (intermediate rail piece).

Referring to FIG. 5, the rearmost side plate $S_n$ has a ridged front end with an upper inclined end face 27 and a lower inclined end face 29 and a straight rear end 32. The upper and lower inclined end faces 27 and 29 are inclined at an angle of some 4 degrees. This angle is designated by the letter $\theta$. Reference numeral 25 designates a front ridge of the rearmost side plate from which the upper and lower inclined end faces 29 and 32 start. The front ridge 25 is located at the same level X—X as the ridge 7 of the associated rail piece and the ridges 25 and 26 of the intermediate side plate. The ridge 25 of the rearmost side plate is rearwardly spaced apart from the ridge 7 of the associated rail piece (rearmost rail piece) by the same distance $E_1$ as the intermediate side plate is offset against the associated rail piece (intermediate rail piece).

Referring to FIG. 2, each side plate ($S_O$ to $S_n$) has a height $H_4$ which is slightly more than one and half times the height $H_1$ of the I-shaped member. The height $H_4$ is slightly more than twice the height $H_2$ of the shelter member. The middle of the height $H_4$ of the side plate coincides with the level X—X at which the ridges of the rail piece and of the side plate are located.

Each of the side plates ($S_O$ to $S_{n-1}$) except the rearmost side plate $S_n$ has a large opening 22 having a center which is in alignment with the rear ridge 8 of the associated rail piece, or coincides with the read ridge 8 when viewed from the side of the side plate.

Each of the side plates ($S_1$ to $S_n$) except the foremost side plate $S_O$ has two horizontally-spaced threaded openings 23 and two vertically-spaced threaded openings 24. Each threaded opening 23 has a center at the same level X—X as the ridges 25 and 26 of the side plate are located. The threaded openings 24 are equally spaced apart from the level X—X.

The side plates are in contact with each other at the ridges 25 and 26 thereof.

Connecting Plate

Connecting plates $Q_1$ to $Q_n$ connect the side plates $S_O$ to $S_n$ together and, hence, connect the rail pieces together.

As with the side plates, the connecting plates are provided on both sides of the rail pieces.

As shown in FIG. 6, each connecting plate bridges and connects adjacent side plates. For example, a foremost connecting plate $Q_1$ connects the foremost side plate $S_O$ and the second side plate $S_1$. A second connecting plate $Q_2$ connects the second side plate $S_1$ and the third side plate $S_2$. A rearmost connecting plate $Q_n$ connects the side plate $S_{n-1}$ and the rearmost side plate $S_n$.

As shown in FIG. 6, all the connecting plates $Q_1$ to $Q_n$ have identical shapes.

Also, the shape of the connecting plate is identical with that of the intermediate side plate ($S_1$ to $S_{n-1}$) except for the location of openings.

Also, the connecting plate has its top and bottom at the same levels as the side plate. The connecting plate, however, is forwardly offset for a distance $E_2$ (which is twice the distance $E_1$) against the rear one of the adjacent side plates connected thereby. From a different point of view, the front ridge of the connecting plate is forwardly offset for a distance $E_3$ against the front ridge 7 of the rail piece when viewed from the side of the connecting plate.

Reference numerals 33 and 34 designate longitudinally opposed ridges of the connecting plate. The ridges 33 and 34 are located at the same level X—X as the ridges 25 and 26 of the side plate. The illustrated ridges 33 and 34 are clear-cut angles rather than otherwise. However, if desired, rounded ridges may be provided instead of such ridges.

Reference numerals 39 and 38 designate opposed sides of the upper tapered portion of the connecting plate. Reference numerals 40 and 41 designate opposed sides of the lower tapered portion of the connecting plate. The opposed sides 39, 38, 40 and 41 are all inclined at an angle of some 4 degrees. This angle is designated by the letter $\theta$.

The connecting plate has vertically-spaced openings 37 which are in alignment with the threaded openings 24 of the side plate. Also, the connecting plate has horizontally-spaced openings 36 which are in alignment with the threaded openings 23 of the side plate.

Bolts 46 are inserted into the openings 37 and 24, and bolts 45 are inserted into the openings 36 and 23. The threads of the bolts 46 and 45 are in engagement with the threads of the openings 24 and 23. The connecting plate is thus fixed to the rear one of adjacent side plates by the bolts 46 and 45.

Also, the connecting plate has a large opening 35 which is in alignment with the large opening 22 of the side plate. A pivotal bolt is inserted into the openings 35 and 22.

The connecting plates are in contact with each other with the ridges 33 and 34 thereof.

Pivotal Bolt

A pivotal bolt ($P_1$ to $P_n$) is inserted into the large openings 35 and 22.

As shown in FIG. 1, the pivotal bolt comprises an inner, large-diameter portion 42 and an outer, small-diameter portion 43. The small-diameter portion 43 is fitted into the opening 35 of the connecting plate, and is welded to the connecting plate as indicated by reference numeral 44 of FIG. 8. The pivotal bolt is thus fixed to the connecting plate. On the other hand, the large-diameter portion 42 is rotatably received in the opening 22 of the side plate. Thus, the pivotal bolt, fixed to the connecting plate, is rotatably received in the opening 22 of the side plate.

Thus, the connecting plate is fixed to the rear one of adjacent side plates, but is connected to the front side plate for pivotal movement in a vertical plane. From a different point of view, the connecting plate serves to connect the adjacent side plates to each other such that the rear side plate is capable of pivotal movement (in a vertical plane) relative to the front side plate.

Thus, the connecting plates $Q_1$ to $Q_n$, with their pivotal bolts $P_1$ to $P_n$, connect the side plates $S_O$ to $S_n$ together for pivotal movement (in a vertical plane) relative to each other. It means that the rail pieces are capable of pivotal movement (in a vertical plane) relative to each other.

Action of the Flexible Rail

The rail piece, the side plates fixed thereto, and the connecting plates fixed to the side plates may be collectively called an "arcing unit" since these components, as one body, can move in an arc, or make a pivotal movement, in a vertical plane.

The rail pieces are in alignment with each other in a longitudinal direction. It is also the case with the side plates and the connecting plates. Thus, shortly after starting to arc, the arcing unit is stopped since the upper or lower inclined end faces thereof come into contact with the opposed (upper or lower) inclined end faces of the adjacent arcing unit.

Figure 9:
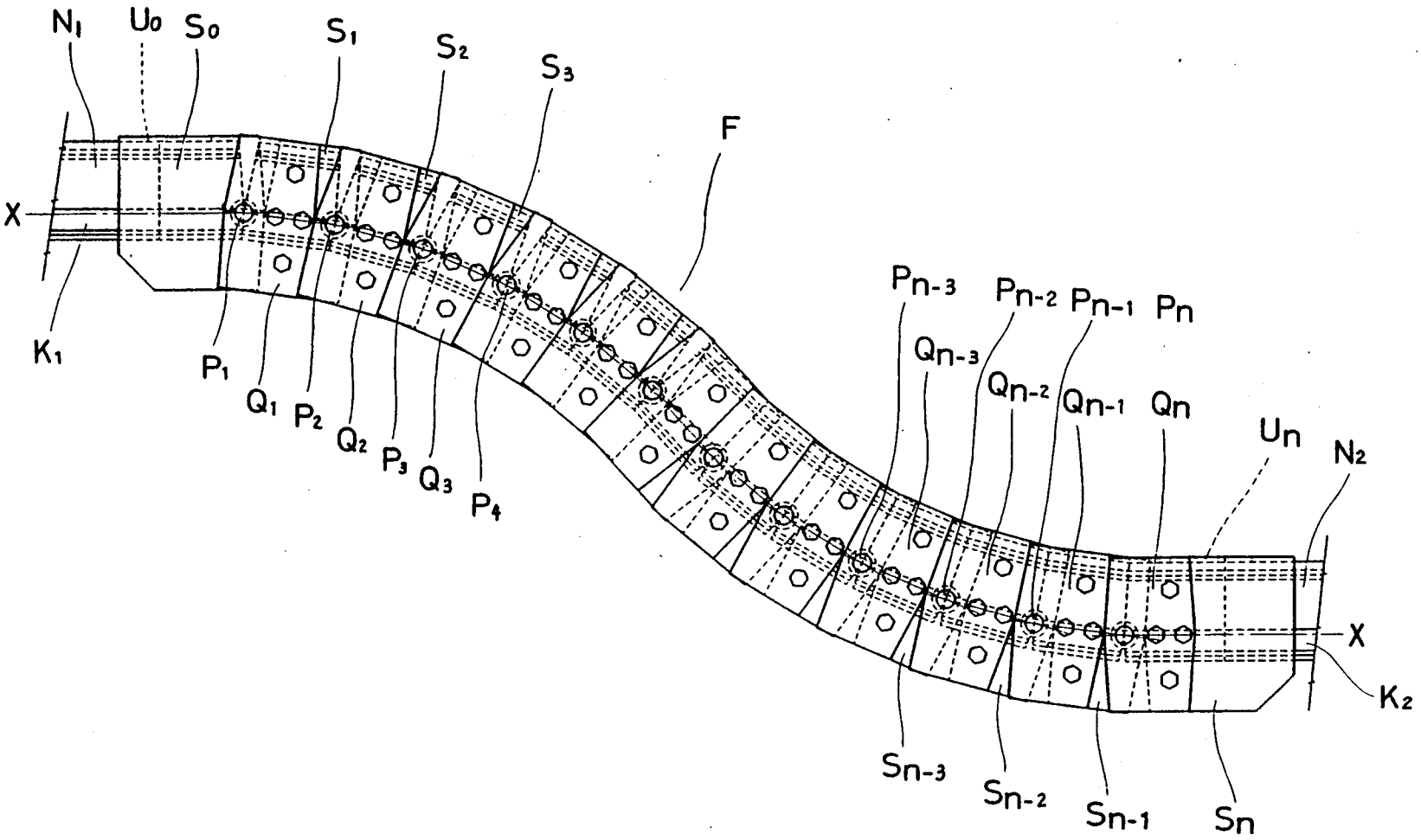
FIG. 9 illustrates how the flexible rail flexes.

In use, as shown in FIGS. 4, 5 and 9, the foremost rail piece may be fixed to a nonflexible rail member $K_1$, and the rearmost rail piece may be fixed to a nonflexible rail member $K_2$. Then, if one of the nonflexible rail members $K_1$ and $k_2$ is fixed and the other nonflexible rail member $K_1$ or $k_2$ is vertically moved, the flexible rail F flexes, or makes a wavy motion, in a vertical plane as illustrated in FIG. 9.

In FIG. 9, the arcing units nearer to the rail member $K_1$ are in contact with each other at their lower inclined end faces, while the arcing units nearer to the rail member $K_2$ are in contact with each other at their upper inclined end faces. Thus, in FIG. 9, each arcing unit is in contact with the adjacent arcing units at its lower or upper inclined end faces. However, it will be appreciated that, if a flexible rail longer than illustrated in FIG. 9 is flexed as shown in FIG. 9, the central arcing units of such a longer flexible rail do not come into contact with the adjacent arcing units at their lower or upper inclined end faces, but remain in contact with the adjacent arcing units only at their front and rear ridges.

Figure 10:
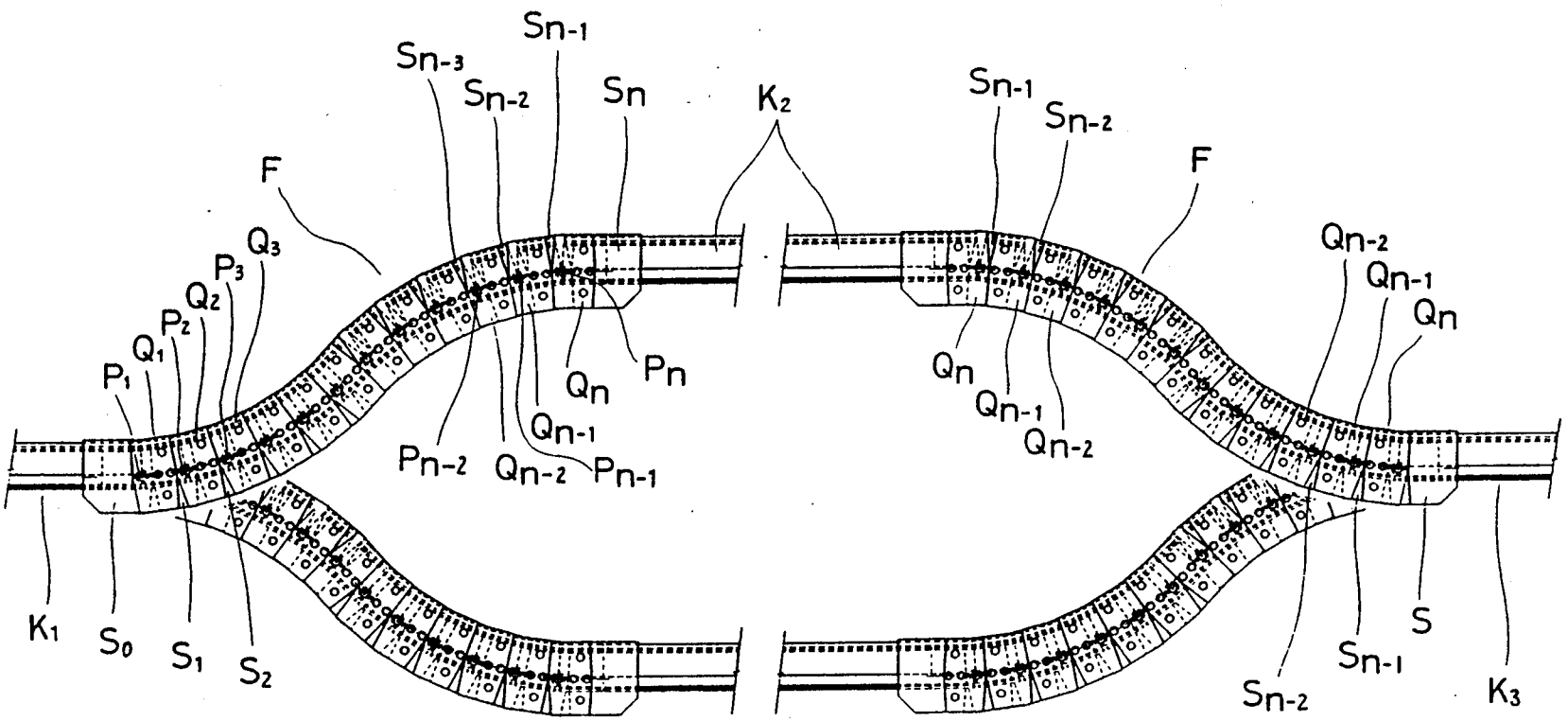
In FIG. 10, one flexible rail F of the invention is connected between a fixed nonflexible rail $K_1$ and a central vertically-movable nonflexible rail $K_2$, an additional flexible rail F of the invention is connected between the central non-flexible rail $K_2$ and a fixed nonflexible rail $K_3$. When the central nonflexible rail $K_2$ is moved vertically, the flexible rails F flex as illustrated.

Also, the flexible rail F of the invention can be used as illustrated in FIG. 10. That is, one flexible rail F can be connected between a fixed rail member $K_1$ and a vertically-movable central rail member $K_2$, , and another flexible rail F can be connected between the central rail member $K_2$ and a fixed rail member $K_3$. Then, when the central rail member $K_2$ is moved vertically, the flexible rails F flex as shown in FIG. 10.

In use, as shown in FIGS. 7 and 8, a trolley T can be carried on the rail piece. To be more exact, the trolley T can be suspended from the I-shaped member of the rail piece with its rollers 48 resting on the bottom 2 of the I-shaped member. The rollers 48 roll on the bottoms 2 of the successively arranged I-shaped members.

When the flexible rail F is not flexed, but is in a straight position (as in FIG. 6), small gaps exist between the bottoms 2 of the adjacent rail pieces. As described above, when the flexible rail F flexes, some of the rail pieces come into contact with each other at their lower inclined end faces. Hence, with flexure of the flexible rail, these rail pieces also come into contact with each other at their bottoms 2 and, therefore, provide a continuous surface for supporting the rollers 48. Accordingly, the rollers 48 roll smoothly on such rail pieces. However, when the rollers 48 roll on the rail pieces which remain in contact with each other only at their ridges and on the rail pieces which are in contact with each other at their upper inclined end faces, the rollers 48 must pass over the gaps between the bottoms 2 of such rail pieces. Therefore, the gaps between the rail pieces should not be or become so large that the rollers 48 may get into the gaps and stop. Thus, two factors are considered to eliminate such a possibility. First, the ridges of the components of the arcing unit are located at a relatively low level, i.e., at the height X—X which is substantially one third of the height $H_1$ of the I-shaped member. Second, the upper and lower inclined end faces of the components which start from the ridges are all inclined at a relatively small angle, i.e., substantially 4 degrees. It will be appreciated, however, that, if desired, the angles of the upper and lower inclined end faces may be even smaller. For example, these angles may be 2 degrees. And if such a smaller angle is used, the I-shaped member may be ridged at the middle of its height. In such a case, the side plate and the connecting plate must be ridged at the same level as the I-shaped member.

Modifications

Although not shown, if desired, the flexible rail of the invention can be inverted in use. For example, two inverted units of the flexible rail can be located in parallel with each other. And trolleys can be supported on the respective inverted flexible rails, and connected by lateral bars. Then, works can be supported on the lateral bars. Then, the trolleys can be moved with their bottoms supported on the flexible rails.

Figure 11:
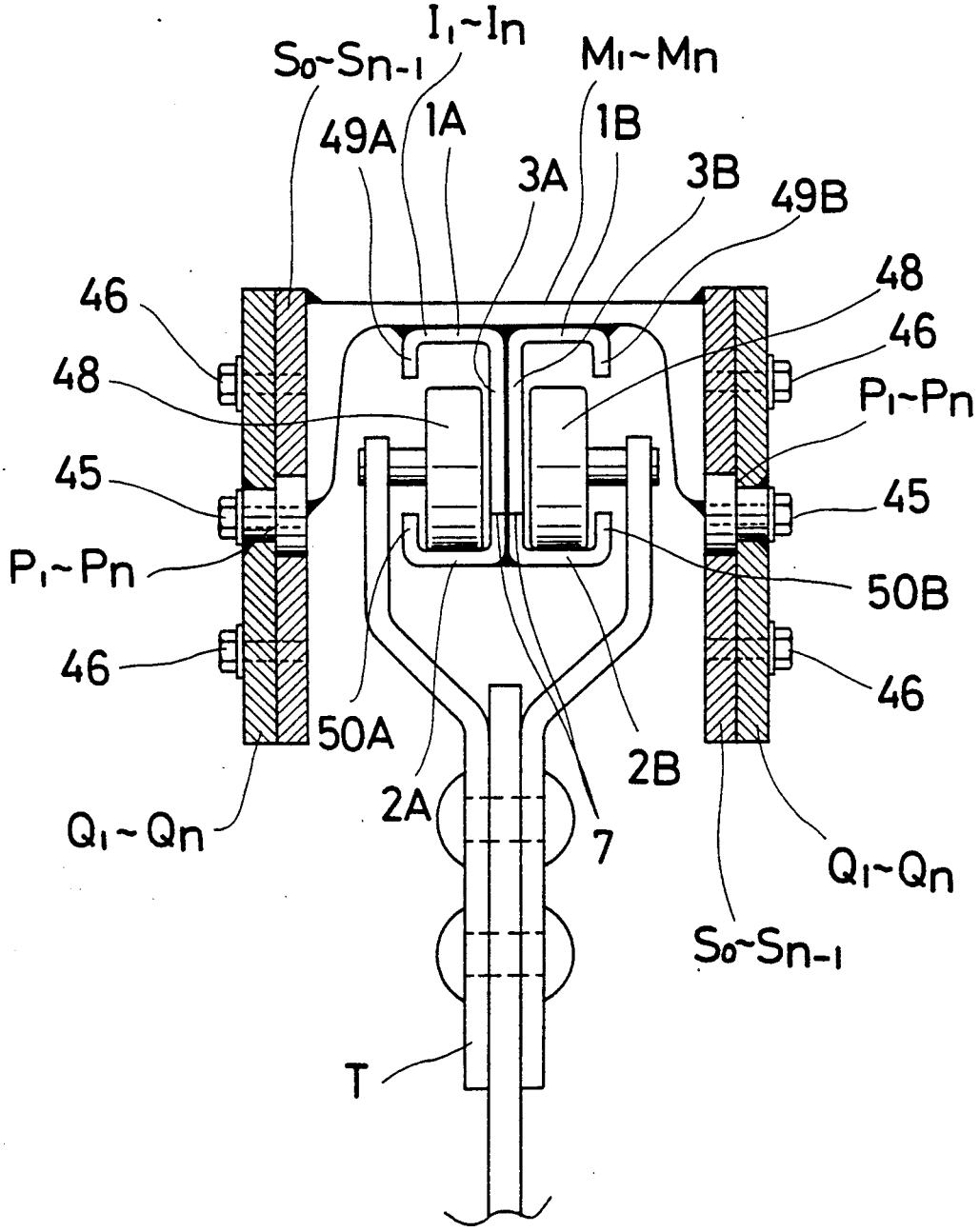
FIG. 11 shows a different embodiment of the invention.

Also if desired, as shown in FIG. 11, two C-shaped members connected fixed together can be used instead of the I-shaped member. In FIG. 11, the two C-shaped members are fixed together back to back. In FIG. 11, parts the same as or corresponding to those of the preceding embodiment are designated by the same reference numerals.

Furthermore, although not shown, if desired, an H-shaped member can be used instead of the I-shaped member.

With the preceding embodiment, each component of the arcing unit (that is, rail piece, side plate, and connecting plate) has upper and lower inclined end faces. If, for example, the flexible rail F flexes as shown in FIG. 9, the arcing units nearer to the nonflexible rail $K_1$ come into contact with each other at their lower inclined end faces thereof while the arcing units nearer to the other nonflexible rail $K_2$ come into contact with each other at their upper inclined end faces. As described before, if the flexible rail is longer than shown in FIG. 9, the central arcing units may remain in contact with each other only at their ridges. When rolling on the rail pieces (to be more exact, on the bottoms of the I-shaped members), the rollers 48 of the trolley T are supported more stably by the adjacent components which are in contact with each other at their upper or lower inclined end faces than by the adjacent components which remain in contact with each other only at their ridges. Thus, it is preferable that the flexible rail includes many components which may come into contact with each other at upper or lower inclined end faces. It is a particularly important consideration if the trolley T is used to convey heavy objects. But if lightweight objects are to be conveyed by the trolley, only one or two of the three components of the flexible rail may be provided with upper and lower inclined opposite end faces. For example, only rail pieces may be formed as illustrated, and rectangular side plates and rectangular connecting plates may be used.

Moreover, although not shown, the side plate and the connecting plate may be formed integrally without changing the overlapping relationship between the two.

The flexible rail of the invention has so far been described as usable for a trolley conveyor. However, other uses are also possible. For example, the flexible rail can be used for a conveyor comprising parallel conveyor chains connected by lateral bars from which works are suspended.

In particular, the flexible rail of the invention can be used in a system for electrodeposition coating automobile parts, electrical components or other kinds of parts with paint. For such a use, plural flexible rails can be connected between non-flexible rails as illustrated in FIG. 10. Tanks supplied with paint can be placed directly below the central vertically-movable nonflexible rail $K_2$. When works suspended from the trolleys come directly below the central rail $K_2$, the conveyor is stopped. Then, the central rail $K_2$ is moved downward to immerse the works in the paint in the tanks, and then is moved upward. The flexible rails flex concomitantlly with the vertical movement of the central rail $K_2$. It is not necessary to move the tanks vertically.

What is claimed is:

1. A flexible rail comprising (i) rail pieces arranged in line and each including a generally I-shaped member and a shelter member which is fixed to a top of the I-shaped member, (ii) a pair of laterally opposed side plates fixed to respective side walls of the shelter member, each of the opposed side plates overlapping one side of the rail piece, (iii) a pair of laterally opposed connecting plates each overlapping both of adjacent side plates on one of opposed sides, (iv) means for fixing the connecting plate only to a rear one of the adjacent side plates, and (v) a pair of pivotal means provided in conjunction with the opposed connecting plates, respectively, for connecting the connecting plate to a front one of the adjacent side plates for pivotal movement in a vertical plane.

2. A flexible rail in accordance with claim 1 wherein at least one of the rail piece, the side plate, and the connecting plate includes an upper tapered portion with opposed upper inclined end faces starting from longitudinally opposed ridges respectively, and a lower tapered portion with opposed lower inclined end faces starting from the longitudinally opposed ridges, respectively, except that a foremost rail piece and a rearmost rail piece each have an inner upper inclined end face starting from an inner ridge and an inner lower inclined end face starting from the inner ridge and an outer straight end face and a foremost side plate and a rearmost side plate each have an inner upper inclined end face starting from an inner ridge and an inner lower inclined end face starting from the inner ridge and an outer straight end face.

3. A flexible rail in accordance with claim 2 wherein each of intermediate side plates has substantially the same longitudinal dimension as the rail piece to which the intermediate side plate is fixed, and the intermediate side plate is offset against the associated rail piece in one longitudinal direction by a first predetermined distance $E_1$.

4. A flexible rain in accordance with claim 3 wherein each of the connecting plates has substantially the same longitudinal dimension as the intermediate side plate, and is offset against the intermediate side plate to which the connecting plate is fixed, in an opposed longitudinal direction by a second predetermined distance $E_2$ which is substantially twice the first predetermined distance $E_1$.

5. A flexible rail in accordance with claim 4 wherein the pivotal means are located at the same level as the ridges.

6. A flexible rail in accordance with claim 2 wherein the ridges are clear-cut angles.

7. A flexible rail in accordance with claim 2 wherein the ridges are rounded ridges.

8. A flexible rail in accordance with claim 2 wherein each of the inclined end faces is inclined at an angle of substantially 4 degrees with respect to the ridge.

9. A flexible rail in accordance with claim 2 wherein the pivotal means are located at the same level as the ridges.

10. A flexible rail in accordance with claim 1 wherein each of intermediate side plates has substantially the same longitudinal dimension as an associated rail piece, or the rail piece to which the intermediate side plate is fixed, and the intermediate side plate is offset against the associated rail piece in one longitudinal direction by a first predetermined distance $E_1$.

11. A flexible rail in accordance with claim 10 wherein each of the connecting plates has substantially the same longitudinal dimension as the intermediate side plate, and is offset against the intermediate side plate to which the connecting plate is fixed, in an opposed longitudinal direction by a second predetermined distance $E_2$ which is substantially twice the first predetermined distance $E_1$.

12. A flexible rail comprising (i) rail pieces arranged in line and each including a generally I-shaped member and a shelter member which is fixed to a top of the I-shaped member, (ii) a pair of laterally opposed side plates fixed to respective side walls of the shelter member, each of the opposed side plates overlapping one side of the rail piece, (iii) a pair of laterally opposed connecting plates each overlapping both of adjacent side plates on one of opposed sides, (iv) means for fixing the connecting plate only to a rear one of the adjacent side plates, (v) a pair of pivotal means provided in conjunction with the opposed connecting plates, respectively, for connecting the connecting plate to a front one of the adjacent side plates for pivotal movement in a vertical plane, (vi) the rail piece, the side plate, and the connecting plate each including an upper tapered portion with opposed upper inclined end faces starting from longitudinally opposed ridges, respectively, and a lower tapered portion with opposed lower inclined end faces starting from the longitudinally opposed ridges, respectively except that a foremost rail piece and a rearmost rail piece each have an inner upper inclined end face starting from an inner ridge and an inner lower inclined end face starting from the inner ridge and an outer straight end face, and a foremost side plate and rearmost side plate each have an inner upper inclined end face starting from an inner ridge and an inner lower inclined end face starting from the inner ridge and an outer straight end face, and (vii) all said ridges being located at the same level.

13. A flexible rail in accordance with claim 12 wherein the ridges are clear-cut angles.

14. A flexible rail in accordance with claim 13 wherein each of the inclined end faces is inclined at an angle of substantially 4 degrees with respect to the ridge.

15. A flexible rail in accordance with claim 13 wherein the pivotal means are located at the same level as the ridges.

16. A flexible rail in accordance with claim 12 wherein the ridges are rounded ridges.

17. A flexible rail in accordance with claim 16 wherein each of the inclined end faces is inclined at an angle of substantially 4 degrees with respect too the ridge.

18. A flexible rail in accordance with claim 12 wherein each of the inclined end faces is inclined at an angle of substantially 4 degrees with respect to the ridge.

19. A flexible rail in accordance with claim 18 wherein the pivotal means are located at the same level as the ridges.

20. A flexible rail in accordance with claim 12 wherein each of intermediate side plates has substantially the same longitudinal dimension as the rail piece to which the intermediate side plate is fixed, and the intermediate side plate is offset against the associated rail piece in one longitudinal direction by a first predetermined distance $E_1$.

21. A flexible rail in accordance with claim 20 wherein each of the connecting plates has substantially the same longitudinal dimension as the intermediate side plate, and is offset against the intermediate side plate to which the connecting plate is fixed, in an opposed longitudinal direction by a second predetermined distance $E_2$ which is substantially twice the first predetermined distance $E_1$.

22. A flexible rail in accordance with claim 21 wherein the pivotal means are located at the same level as the ridges.

23. A flexible rail in accordance with claim 12 wherein the pivotal means are located at the same level as the ridges.

24. A flexible rail comprising (i) rail pieces arranged in line and each including a generally I-shaped member and a shelter member which is fixed to a top of the I-shaped member, the I-shaped member having a bottom for supporting rollers of a trolley which is to be conveyed along the flexible rail, (ii) a pair of laterally opposed side plates fixed to respective side walls of the shelter member, each of the opposed side plates overlapping one side of the rail piece, (iii) a pair of laterally opposed connecting plates each overlapping both of adjacent side plates on one of opposed sides, (iv) means for fixing the connecting plate only to a rear one of the adjacent side plates such that the rail piece, the side plates fixed thereto, and the connecting plates fixed to the side plates constitute a united body, (v) a pair of pivotal means provided in conjunction with the opposed connecting plates, respectively, for connecting the connecting plate to a front one of the adjacent side plates for pivotal movement in a vertical plane, thereby allowing the united body to make a pivotal movement in a vertical plane, (vi) the rail piece, the side plate, and the connecting plate each including an upper tapered portion with opposed upper inclined end faces starting from longitudinally opposed ridges, respectively, and a lower tapered portion with opposed lower inclined end faces starting from the longitudinally opposed ridges, respectively, except that a foremost rail piece and a rearmost rail piece each have an inner upper inclined end face starting from an inner ridge and an inner lower inclined end face starting from the inner ridge and an outer straight end face, and a foremost side plate and a rearmost side plate each have an inner upper inclined end face starting from an inner ridge and an inner lower inclined end face starting from the inner ridge and an outer straight end face, (vii) all said ridges being located at the same level, and (viii) pivotal-movement limiting means for limiting the pivotal movement of the rail piece, the side plates fixed thereto and the connecting plates fixed to the side plates to a relatively small range.

25. A flexible rail in accordance with claim 24, wherein the inclined end faces of the united body provide said pivotal-movement limiting means by coming into contact with adjacent inclined end faces of adjacent united bodies.

26. A flexible rail in accordance with claim 25 wherein the ridges are clear-cut angles.

27. A flexible rail in accordance with claim 26 wherein each of the inclined end faces is inclined at an angle of substantially 4 degrees with respect to the ridge.

28. A flexible rail in accordance with claim 27 wherein each of intermediate rail pieces, each of intermediate side plates, and each of the connecting plates have substantially the same longitudinal dimension, and the intermediate side plate is offset against the rail piece to which the intermediate rail piece is fixed, in one longitudinal direction b a first predetermined distance $E_1$, which each of the connecting plates is offset against the intermediate side plate to which the connecting plate is fixed, in an opposed longitudinal direction by a second predetermined distance $E_2$ which is substantially twice the first predetermined distance $E_1$.

29. A flexible rail in accordance with claim 25 wherein the ridges are rounded ridges.

30. A flexible rail in accordance with claim 25 wherein each of intermediate rail pieces, each of intermediate side plates, and each of the connecting plates have substantially the same longitudinal dimension, and the intermediate side plate is offset against the rail piece to which the intermediate rail piece is fixed, in one longitudinal direction by a first predetermined distance $E_1$, while each of the connecting plates is offset against the intermediate side plate to which the connecting plate is fixed, in an opposed longitudinal direction by a second predetermined distance $E_2$ which is substantially twice the first predetermined distance $E_1$.

31. A flexible rail comprising (i) rail pieces arranged in line and each including a generally I-shaped member and a shelter member which is fixed to a top of the I-shaped member, the I-shaped member having a bottom for supporting rollers of a trolley which is to be conveyed along the flexible rail, (ii) a pair of laterally opposed side members each including (a) a side plate element fixed to one of side walls of the shelter member and overlapping one side of the rail piece and (b) a connecting plate element formed integrally with the side plate element and overlapping both of adjacent side plate elements, (iii) a pair of pivotal means provided in conjunction with the opposed side members, respectively, for connecting the side member to an adjacent front side member for pivotal movement in a vertical plane, thereby allowing the side member and the associated rail piece to make a pivotal movement, as one body, in a vertical plane, (vi) the rail piece, the side plate element, and the connecting plate element each including an upper tapered portion with opposed upper inclined end faces starting from longitudinally opposed ridges, respectively, and a lower tapered portion with opposed lower inclined end faces starting from the longitudinally opposed ridges, respectively, except that a foremost rail piece and a rearmost rail piece each have an inner upper inclined end face starting from an inner ridge and an inner lower inclined end face starting from the inner ridge and an outer straight end face, and a foremost side plate element and a rearmost side plate element each have an inner upper inclined end face starting from an inner ridge and an inner lower inclined end face starting from the inner ridge and an outer straight end face, and (v) all said ridges being located at the same level.

* * * * *